United States Patent [19]

Williams

[11] Patent Number: 4,705,405

[45] Date of Patent: Nov. 10, 1987

[54] MIXING APPARATUS

[75] Inventor: Leslie P. Williams, Port Neches, Tex.

[73] Assignee: CCA, Inc., Port Neches, Tex.

[21] Appl. No.: 849,690

[22] Filed: Apr. 9, 1986

[51] Int. Cl.[4] ..... B01F 15/02

[52] U.S. Cl. ..... 366/160; 366/162; 366/177; 366/182

[58] Field of Search ..... 366/150, 76, 131, 132, 366/134, 160, 162, 177, 181, 182, 348, 349; 422/133, 135

[56] References Cited

U.S. PATENT DOCUMENTS 4,475,821 10/1984 Koch et al. ..... 366/160

*Primary Examiner*—Timothy F. Simone

*Attorney, Agent, or Firm*—Pravel, Gambrell, Hewitt, Kimball & Krieger

[57] ABSTRACT

An apparatus for mixing chemicals comprises a motive fluid inlet, a first and second chemical inlet and a chemical outlet. An eductor draws chemicals through the first and second inlets and mixes them with a motive fluid. Restriction devices are provided in each chemical inlet to regulate the ratio of chemicals mixed by the apparatus. The mixture of chemical and motive fluid creates a stabilized foam water solution which is mechanically adjusted by a nozzle producing stabilized foam.

17 Claims, 1 Drawing Figure

MIXING APPARATUS

FIELD OF THE INVENTION

This invention relates to static mixing devices.

BACKGROUND OF THE INVENTION

Pollution from industrial waste has been a chronic problem for chemical manufacturers, processors and refiners. It is not uncommon that during routine plant operations, equipment malfunctions, pipelines break or the process is otherwise upset causing a chemical spill. Only in the recent past has greater attention been focused on the need to quickly and efficiently contain chemical spills to prevent them from absorption into the earth with the attendant pollution problems of the adjacent aquifers which provide drinking water to nearby communities. Spills have brought other hazards mainly from the toxicity standpoint as a result of wind driven vapors adversely affecting the health of residents adjacent chemical manufacturing facilities and toxic waste sites.

As more attention was paid to the need to control spills and toxic waste and limit the impact of such spills on the surrounding communities, techniques were developed to physically contain the spilled material as well as to control poisonous or noxious vapors or odors emitted from the spilled material.

Prior techniques have involved physical containment using earthen barricades or dams. Processing units and storage facilities have been built atop concrete (coated and uncoated) mats so that spills can be channeled to a central location for treatment.

A frequent problem that occurs in sizeable spills is control of vapors or odors from the spilled material. In the past, various foams have been sprayed on the spilled material to minimize the odor and vapor problem. However, these foams broke down after a short time and had to be constantly reapplied to minimize the odor and vapor problem. Since the foam did not last very long, personnel and equipment had to be tied up adjacent the spill site, frequently for days, so that foam could constantly be reapplied as it broke down.

The need to have a stable, longlasting foam as a method of containing vapors and noxious odors is one of the problems addressed by the apparatus of the present invention. It has been determined that a foam can be chemically treated, with a stabilizing compound, so that after it is applied, the foam retains its body and turns into a gel-like substance. The gel-like substance, or stabilized foam, continues to cover the spilled material thereby effectively controlling vapors and odors for periods of time measured in days rather than minutes. In a recent experiment, stabilized foam created by the apparatus of the present invention effectively covered an approximate three acre site for approximately ninety days.

Stabilized foam has another application in bomb disposal application. In the past, bomb squads have attempted to minimize the impact of a bomb, in the event it were to go off, by draping heavy mats over the bomb. This procedure has innate hazards in that the mere setting of the mats could detonate the bomb. Additionally, if a bomb is covered by other objects, such objects may have to be lifted off of the bomb before mats can be set down. Movement of objects off the bomb is another dangerous procedure which could set off the bomb. Other methods have involved spraying liquid nitrogen on the bomb so as to freeze the electrical components in the bomb thereby disarming it. However, this procedure involves transport of cumbersome equipment and handling of extremely cold liquids which can injure personnel if they come in contact with any part of the body. It was thus desirable to provide a method of encasing a bomb so as to limit the damage should the bomb go off. Using the apparatus of the present invention, stabilized foam can be quickly applied to the bomb, thereby encasing it and reducing, if not eliminating, the impact on explosion of the bomb. In one recently conducted experiment, one-sixteenth of a pound of C-4 explosive material was placed in a 3'×3' cardboard box and the box was filled with stabilized foam. When the bomb was detonated, there was no subsequent damage to the box.

The stabilized foam is created by mixing a foam concentrate such as is presently available from the Minnesota Mining and Manufacturing Company under the name AFF/ATC. The stabilizer is also currently available from Minnesota Mining and Manufacturing Company under the description of FX-7000. Combinations of these two chemical yield a stabilized foam which has been found to be beneficial in odor and vapor containment as well as an effective method in reducing or eliminating the impact from bombs frequently encountered by civilian bomb squads.

SUMMARY OF THE INVENTION

An apparatus for mixing chemicals comprises a motive fluid inlet, a first and second chemical inlet and a chemical outlet. An eductor draws chemicals through the first and second inlets and mixes them with a motive fluid. Restriction devices are provided in each chemical inlet to regulate the ratio of chemicals mixed by the apparatus. The mixture of chemicals and motive fluid creates a stabilized foam water solution which is mechanically adjusted by a nozzle producing stabilized foam.

DETAILED DESCRIPTION OF THE PREFERRED EMBODIMENT

Figure 1:
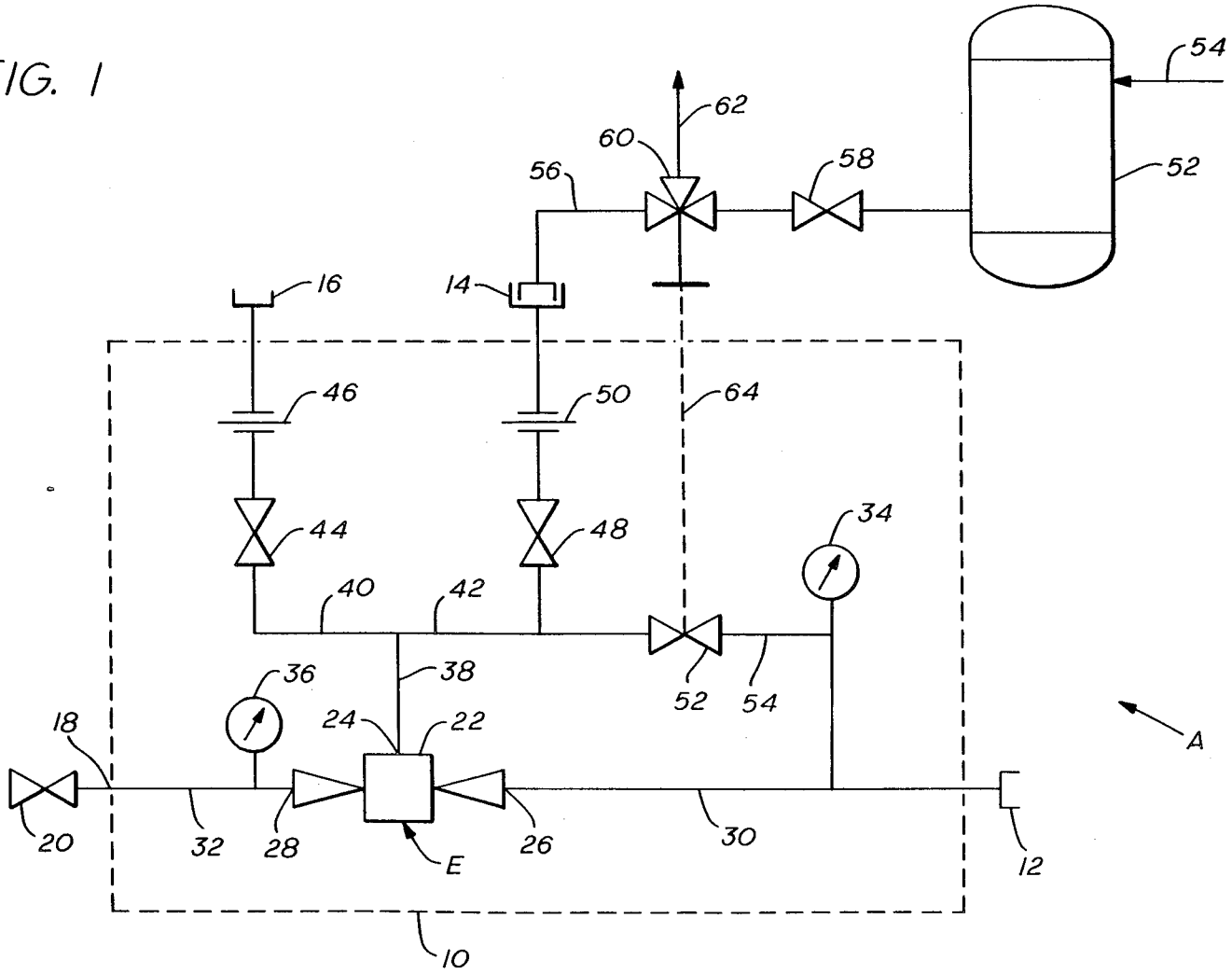
FIG. 1 schematically represents the mixing device of the present invention.

The apparatus A of the present invention is shown in FIG. 1. The dashed rectangle 10 indicates a block of metal preferably a lightweight metal such as aluminum although rigid plastics can be used without departing from the spirit of the invention. Alternatively, the elements shown within rectangle 10 can be assembled in a closed container of suitable construction. The elements within rectangle 10 are machined out of the block. The periphery of the block, represented by dashed lines 10 has a motive fluid inlet 12, a first chemical inlet 14 and a second chemical inlet 16. The block represented by dashed line 10 also includes a chemical outlet connection 18 which may have a suitable valve 20 connected thereto.

FIG. 1 also discloses eductor means E for drawing chemicals through inlets 14 and 16. Eductor means E includes a venturi type eductor 22 having a chemical inlet port 24, a fluid inlet 26 and and fluid outlet 28.

Conduit 30 connects fluid inlet 26 with motive fluid inlet 12. Conduit 32 connects fluid outlet 28 with chemical outlet 18. Pressure gauges 34 and 36 sense the upstream and downstream pressure to eductor 22.

Chemical inlet port 14 is in flow communication with first and second chemical inlets 14 and 16 via conduit 38 which splits into two conduits 40 and 42. Conduit 40 extends from conduit 38 to second fluid inlet 16. Conduit 42 extends from conduit 38 to first fluid inlet 14. Conduit 40 further includes a shut off valve 44 and an orifice restriction 46. Similarly, conduit 42 includes shutoff valve 48 and orifice restriction 50.

The chemicals to be mixed are connected to fluid inlets 14 and 16. Inlet 16 is preferably connected to a foam forming concentrate such as that currently marketed by the Minnesota Mining and Manufacturing Company under the mark AFFF/ATC. A stabilizer such as that sold by Minnesota Mining and Manufacturing under the brand name FX-7000 is connected to first chemical inlet 14. Both the foam concentrate and the stabilizer can be packaged in containers of various size depending on the amount of stabilized foam which must be generated for the proposed application. Typically for small spills or for bomb disposal purposes, the chemicals are packaged in drums varying in size from five to fifty-five gallons.

Because the stabilizing chemical hardens and sets up if in contact with air or water for an extended period of time, the apparatus A must be flushed after each use. Flushing is accomplished by disconnecting chemicals from inlets 14 and 16 while leaving the motive fluid, usually water, connected to inlet 12. Flush valve 52 is disposed in conduit 54. Conduit 54 connects conduit 30 to conduit 42. Those skilled in the art will appreciate that conduit 54 could also be connected to conduit 38 or 40 without departing from the spirit of the invention. When flushing the apparatus A, chemicals are disconnected from inlets 14 and 16 and valve 52 is opened. As a result, water will flow from inlet 12 through conduit 54 and into conduits 40 and 42 exiting through inlets 14 and 16. As a result, the conduits involved will be flushed with liquid thereby removing chemicals therefrom. Some of the circulating liquid goes through inlet 12 through conduit 30 and eductor 22 and exits from the apparatus through chemical outlet 18.

In operation for small spills or for bomb disposal applications, it is desirable to have the components previously described compactly assembled. Dashed rectangle 10 symbolically represents a solid block of metal such a aluminum or a single hard plastic capable of withstanding internal pressures generated. All the conduits, eductor 22, seats for valves 44 and 48 and orifice restrictions 46 and 50 are preferably machined into a solid block. The periphery of the block includes inlets 14 and 16, motive fluid inlet 12 and chemical outlet 18. By incorporating all the elements within dashed rectangle 10 in a solid block, a compact light weight mixing unit is available and can be readily carried around from location to location.

When placing the apparatus A of the present invention in use, motive fluid, usually water, is connected to inlet 12, foam concentrate is connected to inlet 16 and stabilizer is connected to inlet 14. With valve 52 closed, water flows through conduit 30 into eductor 22. The pressure is lowered in conduit 38 thereby drawing chemicals into inlets 14 and 16. The chemicals mix within eductor 22 and the mixture of the chemicals combined with the motive fluid exit from the apparatus at chemical outlet 18. The resulting mixture, a stabilized foam, can then be spread over the spilled fluid or over the bomb, as necessary. Within a short time, the stabilized foam congeals and creates a dense mat over the spilled material or bomb.

In one embodiment designed to produce stabilized foam at the rate of ninety-five gallons a minute, connections 12 and 18 are typically three quarters of an inch while orifices 50 and 46 are one-quarter inch and one-eighth inch, respectively. The orifices may be predrilled into the block represented by dashed rectangle 10 or may be placed in disks which can be interchangeably used in the block so as to realize different compositions for the stabilized foam produced.

In larger applications requiring large amounts of stabilized foam, additional equipment is used with the equipment within dashed rectangle 10. In the larger applications it is desirable to connect chemical inlet 14 to a pressure vessel 52 which is of any size desired but typically one hundred fifty gallons. Vessel 52 is connected to an inert gas blanketing system schematically represented by arrow 54. The inert gas blanketing system typically uses nitrogen and includes a nitrogen source, and a suitable regulator to control the pressure within vessel 52 at the preset point. It is preferred to control the internal pressure of vessel 52 at approximately ten PSIG. The vessel 52 is connected to first chemical inlet 14 via conduit 56. Conduit 56 includes a tank shut off valve 58 located immediately adjacent vessel 52 and a three way valve 60. Three way valve 60 permits flow from vessel 52 to chemical inlet 14, or alternatively prevents flow from vessel 52 into inlet 14. A third position is possible with three way valve 60, to direct the flow of flushing fluid emerging from the block, represented by dashed rectangle 10, from the apparatus A. This flush flow is schematically indicated by arrow 62. The pad of inert gas is necessary in order to prevent air, moisture and other contaminants from entering vessel 52. Such contaminants can cause a stabilizer to set up within vessel 52. As a result, after the use of the apparatus A of the present invention to create a stabilized foam, the foam concentrate is disconnected from chemical inlet 16 and valve 52 is opened. Motive fluid, entering through inlet 12 proceeds as previously described to flush conduits 40 and 42. The flow in conduit 42 enters conduit 46 and exits from the apparatus through three way valve 60 as shown by arrow 62. It should be noted that dashed line 64 schematically represents a mechanical or electrical linkup between valves 60 and 52 so that valve 52 is in the fully opened position before valve 60 can be aligned to allow flow in the direction of arrow 62 out of the apparatus A. This interlock is necessary since vessel 52 is under positive pressure through the blanketing system represented by arrow 54. Thus, an operation of valve 60 to align conduit 56 with the valve port adjacent arrow 62 would allow air to enter conduit 56 (due to eductor 22) adjacent chemical inlet 14 and thereby cause solidification and hardening of the stabilizer plugging the block of apparatus A of the present invention. To avoid this problem, valve 52 is fully opened before valve 60 is aligned to flush material out of the apparatus A. As a result, water passes from inlet 12 through conduit 54 to chemical inlet 14 and out of the apparatus through valve 60 as shown by arrow 62.

The apparatus of the present invention can work with a variety of inlet pressures for the motive fluid although it is preferred to have a minimum pressure of no less than fifty psig at inlet 12.

It can readily be seen that the block represented by dashed lines 10 can be stored in a convenient place, ready to use along with suitably sized containers including the foam concentrate and foam stabilizer. For larger applications, vessel 52 can be trailer mounted or installed in the bed of a pickup truck for ready relocation to the spill site or the location wherein the bomb is located. Application of the stabilized foam generated by the apparatus of the present invention can confine noxious or toxic vapors and odors to a localized area. The stabilized foam retains its sealing capabilities far longer than ordinary foams which must be constantly generated as they dissipate. Furthermore, the strength achieved by the stabilized foam after it has set up is sufficient to minimize the damage caused an exploding bomb of the type frequently encountered by civilian bomb squads.

The foregoing disclosure and description of the invention are illustrative and explanatory thereof, and various changes in the size, shape and materials, as well as in the details of the illustrated construction may be made without departing from the spirit of the invention.

I claim:

1. An apparatus for mixing chemicals comprising:
a motive fluid inlet;
a first chemical inlet
a second chemical inlet;
a chemical outlet;
eductor means having a chemical inlet port theron for inducing flow of a chemical from said first chemical inlet and another chemical from said second chemical inlet into said chemical inlet port, said eductor means having an inlet in flow communication with said motive fluid inlet and an outlet in flow communication with said chemical outlet;
restriction means with said first and second chemical inlets for regulation of chemical flow through said first and second chemical inlets;
a purge conduit extending from said motive fluid inlet to at least one of said first chemical inlet and said second chemical inlet;
a purge valve in said purge conduit; and
whereupon chemical flow from said first and second chemical inlets passes from said chemical inlet port of said eductor means to its outlet and out of the apparatus through said chemical outlet.

2. The apparatus of claim 1 further comprising:
purge means in fluid communication with said motive fluid inlet for purging the apparatus of chemicals.

3. The apparatus of claim 2 wherein said eductor means further comprises of a venturi type eductor.

4. The apparatus of claim 3 wherein said restriction means further comprises:
a first restriction orifice in said first chemical inlet; and
a second restriction orifice in said second chemical inlet.

5. The apparatus of claim 1 further comprising:
a chemical storage vessel connected to said first chemical inlet;
valve means between said chemical storage tank and said first chemical inlet for regulating the flow from said vessel into said first chemical inlet.

6. The apparatus of claim 5 wherein said valve means further comprises:
a three way valve to selectively isolate and allow flow between said vessel and said first chemical inlet and to selectively allow purging of the apparatus by allowing fluid from said motive fluid inlet to flow through said first chemical inlet, into said three way valve and out of the apparatus.

7. The apparatus of claim 6 wherein:
said three way valve and said purge valve are interlocked to require said purge valve to open before said three way valve can be opened.

8. The apparatus of claim 7 wherein:
said purge valve and said three way valve are mechanically interlocked.

9. The apparatus of claim 1 wherein:
a foam stabilizing compound is introduced through said first chemical inlet; and
a foam concentrate is introduced into said second chemical inlet.

10. An apparatus for mixing chemicals comprising:
a motive fluid inlet;
a first chemical inlet
a second chemical inlet;
a chemical outlet;
eductor means having a chemical inlet port thereon for inducing flow of a chemical from said first chemical inlet and another chemical from said second chemical inlet into said chemical inlet port, said eductor means having an inlet in flow communication with said motive fluid inlet and an outlet in flow communication with said chemical outlet;
restriction means with said first and second chemical inlets for regulation of chemical flow through said first and second chemical inlets;
whereupon chemical flow from said first and second chemical inlets passes from said chemical inlet port of said eductor means to its outlet and out of the apparatus through said chemical outlet;
purge means in fluid communication with said motive fluid inlet for purging the apparatus of chemicals;
said eductor means further comprises of a venturi type eductor;
said restriction means further comprises of a first restriction orifice in said first chemical inlet; and
a second restriction orifice in said second chemical inlet;
said eductor means further comprises of a plurality of chemical conduits extending from said chemical inlet port with at least one conduit terminating at said first chemical inlet and another chemical conduit terminating at said second chemical inlet;
said purge means further comprises
a purge conduit extending from said motive fluid inlet to one of said chemical conduits; and
a purge valve in said purge conduit.

11. The apparatus of claim 10 further comprising:
a valve in each said chemical conduit.

12. The apparatus of claim 11 wherein:
said eductor, chemical conduits, purge conduit, and said valves therein are unitarily assembled and formed integrally substantially within a rigid block, said block having said motive fluid inlet, said first and second chemical inlets and said chemical outlet disposed on the periphery thereof.

13. The apparatus of claim 12 comprising:
a chemical storage vessel connected to said first chemical inlet;
valve means between said chemical storage tank and said first chemical inlet for regulating the flow from said vessel into said first chemical inlet.

14. The apparatus of claim 13 wherein:

a foam stabilizing compound is introduced through said first chemical inlet;

a foam concentrate is introduced into said second chemical inlet; and means for blanketing said vessel with an inert gas to prevent ingress of air, water or other contaminants into said vessel and connecting piping up to said valve means.

15. The apparatus of claim 13 wherein said valve means further comprises:

a three way valve to selectively isolate and allow flow between said vessel and said first chemical inlet and to selectively allow purging of the apparatus by allowing fluid from said motive fluid inlet to flow through said first chemical inlet, into said three way valve and out of the apparatus.

16. The apparatus of claim 15 said three way valve and said purge valve are interlocked to require said purge valve to open before said three way valve can be opened.

17. The apparatus of claim 16 wherein:

said purge valve and said three way valve are mechanically interlocked.

* * * * *